US009314830B2

(12) United States Patent
Tremblay et al.

(10) Patent No.: US 9,314,830 B2
(45) Date of Patent: Apr. 19, 2016

(54) BENDING DEVICE

(71) Applicant: FERRARI METALS CORPORATION, Long Beach, CA (US)

(72) Inventors: Arie Tremblay, Long Beach, CA (US); Steven P. Hoekstra, Long Beach, CA (US); Aaron M. Hoekstra, Oxnard, CA (US)

(73) Assignee: Ferrari Metals Corporation, Long Beach, CA (US)

( * ) Notice: Subject to any disclaimer, the term of this patent is extended or adjusted under 35 U.S.C. 154(b) by 0 days.

(21) Appl. No.: 14/754,536

(22) Filed: Jun. 29, 2015

(65) Prior Publication Data

US 2015/0375285 A1 Dec. 31, 2015

Related U.S. Application Data

(60) Provisional application No. 62/019,102, filed on Jun. 30, 2014.

(51) Int. Cl.

| | |
|---|---|
| ***B21D 9/08*** | (2006.01) |
| ***B21D 7/04*** | (2006.01) |
| ***B21D 37/10*** | (2006.01) |
| ***B21D 7/06*** | (2006.01) |

(52) U.S. Cl.

CPC .. *B21D 7/04* (2013.01); *B21D 7/06* (2013.01); *B21D 7/066* (2013.01); *B21D 37/10* (2013.01)

(58) Field of Classification Search

CPC ..... B21D 7/04; B21D 7/06; B21D 7/066; B21D 37/10

USPC ..... 72/389.1, 389.3, 389.6

See application file for complete search history.

(56) References Cited

U.S. PATENT DOCUMENTS

| | | | |
|---|---|---|---|
| 1,164,698 | A | 12/1915 | Artz |
| 1,315,937 | A | 9/1919 | Artz |

(Continued)

FOREIGN PATENT DOCUMENTS

| | | |
|---|---|---|
| CN | 102581090 | 11/2013 |
| EP | 1002591 | 5/2000 |

(Continued)

OTHER PUBLICATIONS

Hebo Machines; Hebo Hydraulic Table; YouTube Video; May 9, 2008; https://www.youtube.com/watch?v=3ID-RauX5VM.

(Continued)

*Primary Examiner* — David B Jones

(74) *Attorney, Agent, or Firm* — Hankin Patent Law, APC; Anooj Patel; Kevin Schraven

(57) ABSTRACT

A bending device. The bending device may comprise: a frame, center die, two sliding dies, and one or more motors. The center die may be positioned at a distal end portion of the frame and may advance towards a proximal end portion of the frame along a first path guide. The first sliding die may be positioned at a left portion of the frame and may advance towards and approximately near the first bent portion of the center die along a second path guide. The second sliding die may be positioned at a right portion of the frame and may advance towards and approximately near the second bent portion of the center die along a third path guide. The motors may actuate the movement of the center die, the first sliding die, and the second sliding die.

20 Claims, 16 Drawing Sheets

(56) References Cited

U.S. PATENT DOCUMENTS

| | | | | | |
|---|---|---|---|---|---|
| 1,461,471 | A | | 7/1923 | Bancroft | |
| 1,865,025 | A | | 6/1932 | Flanagan et al. | |
| 2,357,027 | A | | 8/1944 | Seifried | |
| 2,378,413 | A | | 6/1945 | Lermont et al. | |
| 2,437,092 | A | | 3/1948 | Greene, Jr. et al. | |
| 2,459,132 | A | | 1/1949 | Nielsen | |
| 2,515,752 | A | | 7/1950 | Weightman | |
| 2,527,412 | A | * | 10/1950 | Green | B21D 11/02 72/297 |
| 2,729,265 | A | | 1/1956 | Jones | |
| 2,753,915 | A | | 7/1956 | Raynes | |
| 2,759,513 | A | | 8/1956 | Green | |
| 2,887,141 | A | | 5/1959 | Bower et al. | |
| 2,889,864 | A | * | 6/1959 | Bowser, Jr. | B21D 11/02 72/297 |
| 2,945,528 | A | | 7/1960 | Roux | |
| 3,025,904 | A | | 3/1962 | De Marco | |
| 3,429,157 | A | * | 2/1969 | Huth | B21D 7/06 72/31.05 |
| 4,311,031 | A | | 1/1982 | Schwarze | |
| 5,237,847 | A | * | 8/1993 | Owens | B21D 7/06 72/213 |
| 6,298,706 | B1 | | 10/2001 | Dunn | |
| 6,523,388 | B1 | * | 2/2003 | Winton, III | B21D 7/066 72/389.1 |
| 6,644,087 | B1 | * | 11/2003 | Ralph | B21D 7/066 72/213 |
| 6,931,908 | B1 | | 8/2005 | Mitson | |

FOREIGN PATENT DOCUMENTS

| | | |
|---|---|---|
| WO | 9322078 | 11/1993 |
| WO | 9422609 | 10/1994 |

OTHER PUBLICATIONS

Hebo Machines; Hebo Portable Bending Unit; YouTube Video; Feb. 22, 2008; https://www.youtube.com/watch?v=dpcDY9UO5vY.

Euromac Channel; Bending Machines—Solid Round Bar Bending; YouTube Video; Mar. 22, 2013; https://www.youtube.com/watch?v=dzpMhIjr5CE.

Euromac Channel; Bending Machines—Hard Side Bending; YouTube Video; Mar. 22, 2013; https://www.youtube.com/watch?v=Z3nXrCIASdw.

Allswage UK; Pipe Bending for Steel Tubes C42; YouTube Video; Apr. 29, 2014; https://www.youtube.com/watch?v=k5xwmZ9Lxp4.

Euromac Channel; Bending Machines—Thick Bar Bending; YouTube Video; Mar. 22, 2013; https://www.youtube.com/watch?v=pGyZ-Zkzwv0.

* cited by examiner

BENDING DEVICE

CROSS-REFERENCE TO RELATED APPLICATIONS

This Application claims the benefit of U.S. Provisional Patent Application No. 62/019,102, filed on Jun. 30, 2014, titled "Bending Device", by co-inventors Arie Tremblay, Steven P. Hoekstra, and Aaron Hoekstra, the contents of which are expressly incorporated herein by this reference as though set forth in their entirety, and to which priority is claimed.

FIELD OF THE DISCLOSURE

The present disclosure relates generally to bending devices such as tube-bending devices, and more specifically, to a device for bending metal tubes through a dual push/bend process.

BACKGROUND

In general, bent metal tubing has various uses, including providing an underlying structure for greenhouse roofs, tunnels, or canopies. Although these structures are preferably relatively low cost and easy to construct, the difficulty of bending metal tubes appropriately and efficiently has led to such structures being both expensive and labor intensive to construct.

The most commonly used method to bend metal tubing is through the use of a tubing roller. A tubing roller generally consists of a large wheel with a hand crank. The metal tube is placed in a cavity at the bottom of the large wheel, and the user must then crank the wheel using the hand crank in order to shape the tubing (with the tubing passing through the roller multiple times, depending on the desired radius). This method, however, is very inefficient, as it requires a large amount of physical labor and is very time-consuming.

Another common method for bending metal tubing is utilizing a three roll bender, which generally consists of three smaller wheels and a hand crank. Specifically, a metal tube is generally placed within a gap located between the three wheels and, like above, the hand crank is cranked in order to shape the tubing. Depending on the desired radius, the tubing is typically passed through the bender multiple times. The three roll bender may also comprise an electric motor, which may replace the hand crank, thereby making the bending task less labor intensive. Although both variations of the three roll bender are less labor intensive than the tubing roller, they are both overly time intensive methods for bending metal tubing.

As discussed above, the two prior methods are generally very time intensive and thus are not usually conducive to bending large quantities of tubing. Although it has been suggested to heat the metal tubes to increase efficiency (by decreasing the tubes' stiffness), safety risks raise a concern as a heater must be positioned at a location where the tube is bent.

U.S. Pat. No. 6,931,908, issued to Mitson ("Mitson") discloses a tube bending device comprising two clams, a center die, hydraulic motor, and base. The single center die is configured to push against the metal sheet to bend the metal into the shape of the center die. Because the Mitson reference discloses a tube bending device comprising only a single part that moves in order to bend the tubes, the Mitson bending method does not generally allow users to create dogleg bends, which are generally sharp bends in an otherwise smooth curve.

Similarly, U.S. Pat. No. 3,025,904, issued to De Marco ("De Marco") and U.S. Pat. No. 2,459,132, issued to Nielson ("Nielson") disclose bending devices which comprise a center die that is pushed or pressed against a piece of metal secured at two ends. Like the Mitson reference, the De Marco and Nielson references do not allow a user to create dogleg bends. Additionally, the bending devices disclosed in these references are inefficient, as they require a substantial amount of time to install the metal tubing into the bending device.

U.S. Pat. No. 2,527,412, issued to Green ("Green") discloses a bending device which uses two rocker members and wings, which move downward and outward with a centered die. U.S. Pat. No. 1,315,937, issued to Artz ("Artz") discloses a bending device which uses a ram instead of a die to form bends in metal. Like the De Marco, Nielson, and Mitson references, the bending devices disclosed in the Green and Artz references require an ample amount of time to install a metal tubing for bending.

Therefore, based on the foregoing, what is needed is a bending device that is quick and efficient in bending metal tubes. Preferably, the new and improved bending device will also allow the user to create secondary bends such as dogleg bends.

SUMMARY

To minimize the limitations in the prior art, the present specification discloses a new and useful bending device.

One embodiment may be a bending device, comprising: a frame, a center die, a first sliding die, a second sliding die; and three motors; wherein the center die is moveable connected to the frame and is configured to move linearly towards a proximal end of the frame along a first path guide; wherein the center die comprises an apex portion, a first bent portion, and a second bent portion; wherein the first sliding die is positioned approximately at a left portion of the frame and is configured to advance towards and beyond the first bent portion of the center die along a second path guide; wherein the second sliding die is positioned approximately at a right portion of the frame and is configured to advance towards and beyond the second bent portion of the center die along a third path guide; wherein the three motors are configured to actuate the movement of the center die, the first sliding die, and the second sliding die; wherein the first sliding die, the second sliding die, and the center die are configured to engage and bend a tube; wherein the center die is configured to engage with and push a middle portion of the tube; wherein the first sliding die is configured to push a first end of the tube towards the first bent portion of the center die; and wherein the second sliding die is configured to push a second end of the tube towards the second bent portion of the center die. The second and third path guides may be positioned such that the first and second sliding dies move diagonally towards the first and second bent portions. The center die, the first sliding die, and the second sliding die may be configured to operate simultaneously. The movement of the first sliding die and the second sliding die may continue after a first directional movement of the center die has substantially ended. The second path guide may be positioned at an angle between approximately 20 and 80 degrees with respect to the first path guide. The third path guide may be positioned at an angle between approximately 20 and 80 degrees with respect to the first path guide. The center die may have a convex shape around which the tube will be bent. The center die, the first sliding die, and the second sliding die may each comprise a recessed groove for receiving the tube to be bent. The recessed grooves of the first sliding die and the second sliding die may be in substantial alignment with the recessed groove of the center die, such that when the middle portion of the tube is positioned against the recessed groove of the apex portion of the center die and the first end and the second end of the tube are positioned against the first sliding die and the second sliding die, respectively, the tube may be cradled and supported by the first sliding die, the second sliding die, and the apex potion of the center die. The frame may comprise a trailer hitch for towing the bending device.

Another embodiment may be a bending device, comprising: a frame, a center die, a first sliding die, a second sliding die, a center die motor, and two sliding die motors; wherein the center die is moveable connected to the frame and is configured to move linearly towards a proximal end portion of the frame and retract to the distal end portion of the frame along a first path guide; wherein the center die motor is configured to actuate the movement of the center die; wherein the center die comprises an apex portion, a first bent portion, and a second bent portion; wherein the first sliding die is positioned approximately at a left portion of the frame and is configured to advance towards and beyond the first bent portion of the center die along a second path guide; wherein the second sliding die is positioned approximately at a right portion of the frame and is configured advance towards and beyond the second bent portion of the center die along a third path guide; wherein the two sliding die motors are configured to actuate the movement of the first the sliding die and the second the sliding die; wherein the first sliding die and the second sliding die are in substantial alignment with the apex of the center die, such that the first sliding die, the second sliding die, and the center die are configured to engage and bend a tube; wherein the center die is configured to engage with and push a middle portion of the tube; wherein the first sliding die is configured to push a first end of the tube towards the first bent portion of the center die when the center die advances along the first path guide; and wherein the second sliding die is configured to push a second end of the tube towards the second bent portion of the center die when the center die advances along the first path guide. The second and third path guides may be positioned such that the first and second sliding dies move diagonally towards the first and second bent portions. The center die, the first sliding die, and the second sliding die may be configured to operate simultaneously. The movement of the first sliding die and the second sliding die may continue after a first directional movement of the center die has substantially ended. The second path guide may be positioned at an angle between approximately 30 and 60 degrees with respect to the first path guide; and wherein the third path guide may be positioned at an angle between approximately 30 and 60 degrees with respect to the first path guide. The center die may have a convex shape around which the tube will be bent. The center die, the first sliding die, and the second sliding die may each comprise a recessed groove for receiving the tube to be bent. The recessed grooves of the first sliding die and the second sliding die may be in substantial alignment with the recessed groove of the center die, such that when the middle portion of the tube is positioned against the recessed groove of the apex portion of the center die and the first end and the second end of the tube are positioned against the first sliding die and the second sliding die, respectively, the tube may be cradled and supported by the first sliding die, the second sliding die, and the apex potion of the center die. The frame may comprise a trailer hitch and one or more wheels for towing the bending device.

Another embodiment may be a bending device, comprising: a frame, a center die, a first sliding die, a second sliding die, a center die motor; and two sliding die motors; wherein the center die is moveable connected to the frame and is configured to move linearly towards a proximal end portion of the frame along a first path guide; wherein the center die motor is configured to actuate the movement of the center die; wherein the center die comprises an apex portion, a first bent portion, and a second bent portion; wherein the first sliding die is positioned approximately at a left portion of the frame and is configured to advance towards and beyond the first bent portion of the center die along a second path guide; wherein the second sliding die is positioned approximately at a right portion of the frame and is configured advance towards and beyond the second bent portion of the center die along a third path guide; wherein the two sliding die motors are configured to actuate the movement of the first the sliding die and the second the sliding die; wherein the first sliding die and the second sliding die are in substantial alignment with the apex of the center die, such that the first sliding die, the second sliding die, and the center die are configured to engage and bend a tube; wherein the center die is configured to engage with and push a middle portion of the tube; wherein the first sliding die is configured to push a first end of the tube towards the first bent portion of the center die when the center die advances along the first path guide; wherein the second sliding die is configured to push a second end of the tube towards the second bent portion of the center die when the center die advances along the first path guide; wherein the second and third path guides are positioned such that the first and second sliding dies move diagonally towards the first and second bent portions; wherein the center die, the first sliding die, and the second sliding die are configured to operate simultaneously; wherein the movement of the first sliding die and the second sliding die continues after a first directional movement of the center die has substantially ended; wherein the second path guide is positioned at an angle between approximately 30 and 60 degrees with respect to the first path guide; wherein the third path guide is positioned at an angle between approximately 30 and 60 degrees with respect to the first path guide; wherein the center die has a convex shape around which the tube will be bent; wherein the center die, the first sliding die, and the second sliding die each comprise a recessed groove for receiving the tube to be bent; wherein the recessed grooves of the first sliding die and the second sliding die are in substantial alignment with the recessed groove of the center die, such that when the middle portion of the tube is positioned against the recessed groove of the apex portion of the center die and the first end and the second end of the tube are positioned against the first sliding die and the second sliding die, respectively, the tube is cradled and supported by the first sliding die, the second sliding die, and the apex potion of the center die; and wherein the frame comprises a trailer hitch and one or more wheels for towing the bending device.

It is an object to overcome the deficiencies of the prior art.

These, as well as other components, steps, features, objects, benefits, and advantages, will now become clear from a review of the following detailed description of illustrative embodiments, of the accompanying drawings, and of the claims.

BRIEF DESCRIPTION OF THE DRAWINGS

The drawings show illustrative embodiments, but do not depict all embodiments. Other embodiments may be used in addition to or instead of the illustrative embodiments. Details that may be apparent or unnecessary may be omitted for the purpose of saving space or for more effective illustrations. Some embodiments may be practiced with additional components or steps and/or without some or all components or steps provided in the illustrations. When different drawings contain the same numeral, that numeral refers to the same or similar components or steps.

DETAILED DESCRIPTION OF THE DRAWINGS

In the following detailed description, numerous specific details are set forth in order to provide a thorough understanding of various aspects of one or more embodiments. However, the one or more embodiments may be practiced without some or all of these specific details. In other instances, well-known procedures and/or components have not been described in detail so as not to unnecessarily obscure aspects of the embodiments.

While some embodiments are disclosed herein, still other embodiments will become obvious to those skilled in the art as a result of the following detailed description. These embodiments are capable of modifications of various obvious aspects, all without departing from the spirit and scope of protection. The Figures, and their detailed descriptions, are to be regarded as illustrative in nature and not restrictive. Also, the reference or non-reference to a particular embodiment shall not be interpreted to limit the scope of protection.

In the following description, certain terminology is used to describe certain features of one or more embodiments. For purposes of the specification, unless otherwise specified, the terms "approximately" and "about" generally refer to a deviance of within 5% of the indicated number or range of numbers. In one embodiment, the term "approximately" and "about", refer to a deviance of between 1-10% from the indicated number or range of numbers.

As used herein, the term "substantially" refers to the complete or nearly complete extent or degree of an action, characteristic, property, state, structure, item, or result. For example, in one embodiment, an object that is "substantially" the same in size, shape, and design would mean that the object is either completely the same/identical in size, shape, and design or nearly completely the same/identical in size, shape, and design. The exact allowable degree of deviation from absolute completeness may in some cases depend on the specific context. However, generally speaking the nearness of completion will be so as to have the same overall result as if absolute and total completion were obtained. The use of "substantially" is also equally applicable when used in a negative connotation to refer to the complete or near complete lack of an action, characteristic, property, state, structure, item, or result.

As used herein, the term "tube" refers to a tube, pole, cylinder, duct, pipe, or other structure which may be hollow or solid and is intended to be bent prior to use.

Figure 1:
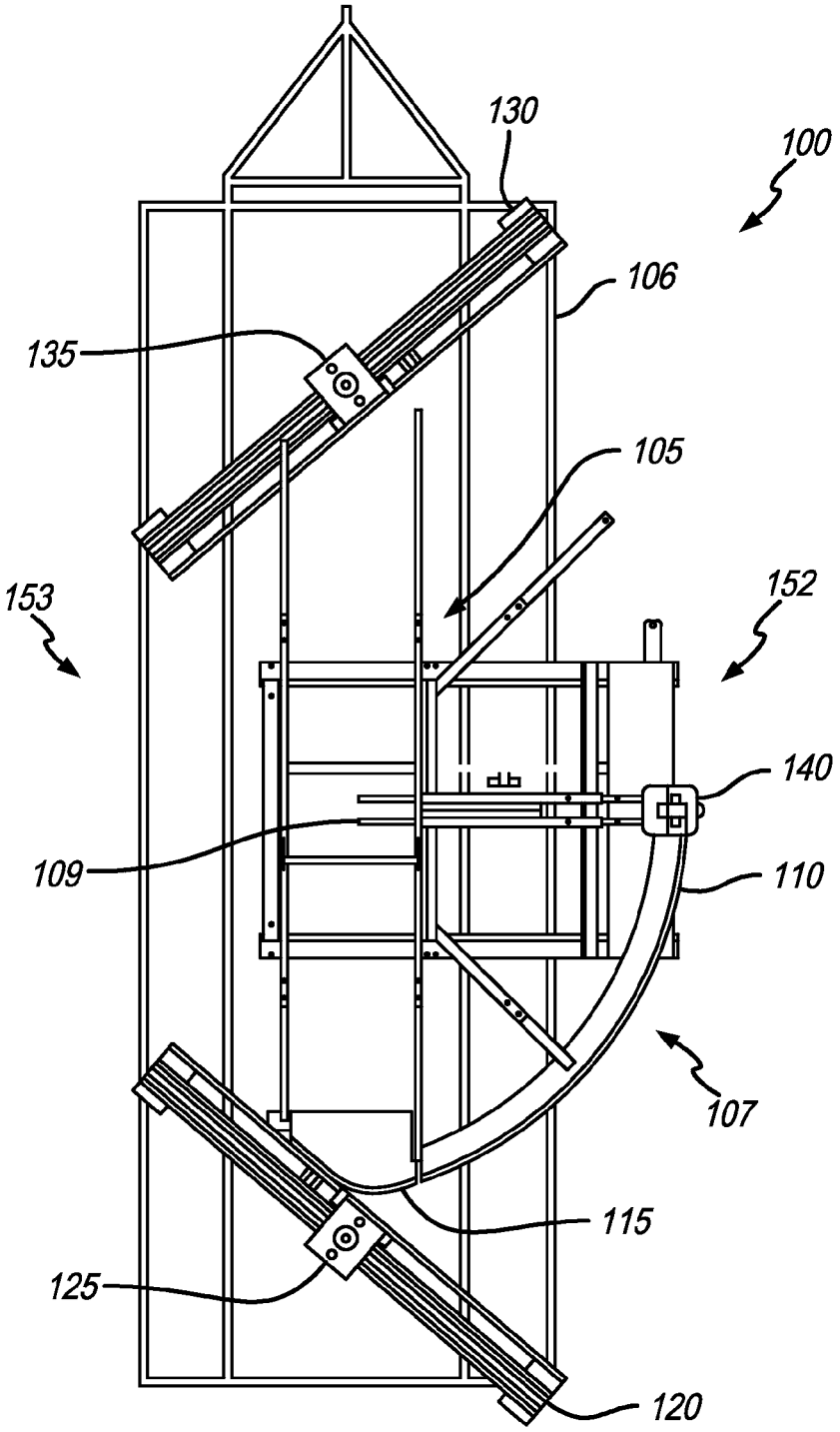
FIG. 1 is an illustration of a top view of one embodiment of the bending device.
Figure 2:
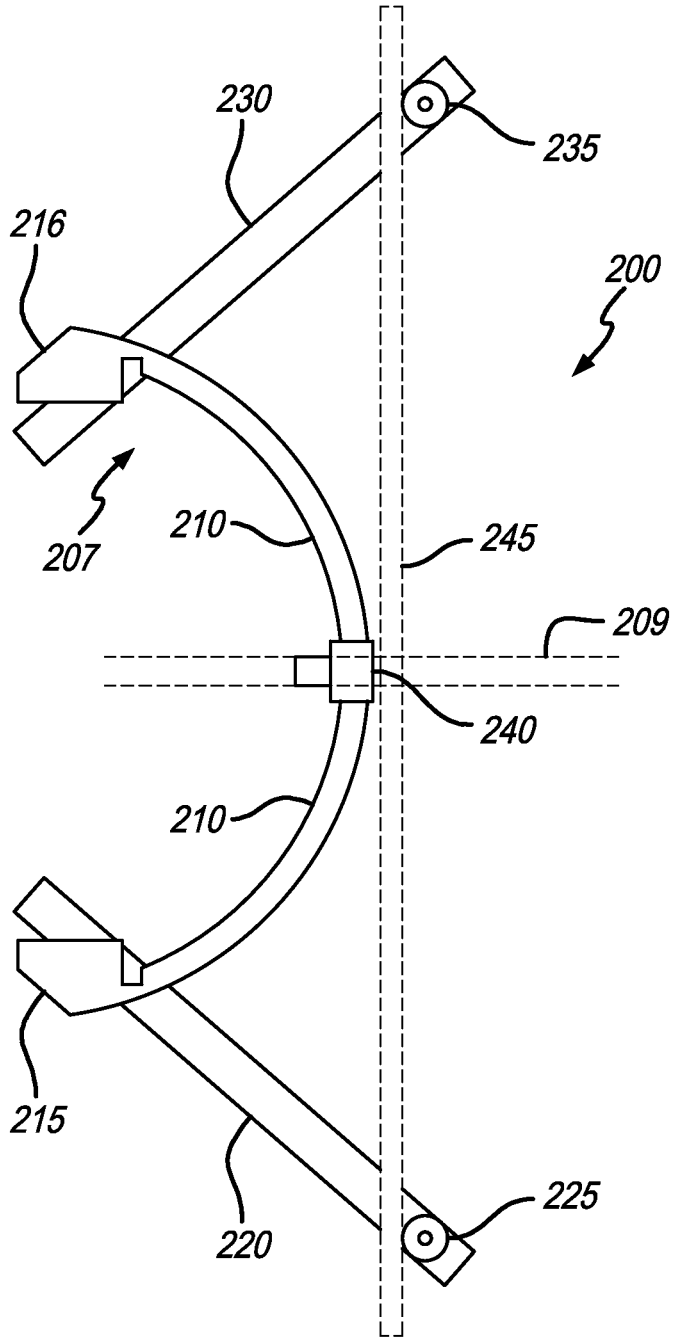
FIG. 2 is an illustration of a top view of one embodiment of the center die, sliding dies, and a tube to be bent and shows the positional relationship of the center die, sliding dies, and tube to be bent at the beginning of the bending process.

FIG. 1 is an illustration of a top view of one embodiment of the bending device. As shown in FIG. 1, one embodiment of the bending device 100 may comprise: a frame 105, bed 106, center die 107, first path guide 109, second path guide 120, first sliding die 125, third path guide 130, second sliding die 135, and an item securing portion 140. The center die 107 may comprise an apex portion 110, a first bent portion 115, and a second bent portion (shown in FIG. 2). The first path guide 109, second path guide 120, and third path guide 130 are preferably rails or guides that control the movement of the center die 107, first sliding die 125, and/or second sliding die 135, and may comprise predetermined path guides. The first path guide 109, second path guide 120, and third path guide 130 may be mounted on the bed 106 and/or on the frame 105. In an embodiment, the center die 107 may be a half design with a single bent portion 115, as shown in FIG. 1. In a preferred embodiment, the center die 107 may preferably comprise two bent portions 110, 115, as shown in FIG. 2. The frame 105 may comprise a metal structure or be constructed from any other rigid material to provide support, structure, rigidity, mass and/or shape to various components of the bending device 100. The first path guide 109 and the center die 107 may be connected to the frame 105. The item securing portion 140 may comprise a mechanism for securing an item (tube, bar, etc . . . ) to be bent, such as a fastener(s) and/or a strap(s). The bed 106 may be a structure used to provide support to the various components of the bending device 100, and may be used to house one or more moving parts to increase safety and reduce the chances of an accident. Some of the moving parts that are covered by the bed 106 may include motors and chains used with the motors to actuate the dies. In an alternative embodiment, the bed 106 or frame 105 may also comprise a trailer hitch for easy transportation.

FIG. 1 shows that, in one embodiment, the center die 107 may be moveably connected to the first path guide 130 and/or the frame 105. The first path guide 130 may be configured to cause the center die 107 to move in a substantially straight, predetermined path (i.e., first predetermined path) relative to the frame 105 and bed 106. Preferably, the center die 107 is configured to move linearly towards a proximal end portion 152 of the frame 605 and retract to the distal end portion 153 of the frame 605 along a first path guide. The shape of the center die 107 may be constructed to be of any shape, but is preferably a convex curve to allow the tube to be bent in a curved shape.

FIG. 1 also shows that the first sliding die 125 may be moveably connected to the second path guide 120 and may be configured to move along a second predetermined path created by the second path guide 120. In one embodiment, the second path guide 120 may be configured to cause the first sliding die 125 to move in a substantially straight, predetermined path (i.e., second predetermined path). The second predetermined path may preferably be positioned at an angle between approximately 20 and 80 degrees with respect to the first predetermined path.

FIG. 1 shows that the second sliding die 135 may be moveably connected to the third path guide 130 and may be configured to move along a third predetermined path created by the third path guide 130. In one embodiment, the third path guide 130 may be configured to cause the second sliding die 135 to move in a substantially straight, predetermined path (i.e., third predetermined path). The third predetermined path may preferably be positioned at an angle between approximately 20 and 80 degrees with respect to the first predetermined path.

The movement of the center die 107, first sliding die 125, and second sliding die 135 may be interrelated. For example, in one embodiment, the center die 107, first sliding die 125, and second sliding die 135 may all begin moving approximately at the same time in order to efficiently bend a tube or other item placed in-between the center sliding die 107, first slide die 125, and second sliding die 135. The center die 107, first sliding die 125, and second sliding die 135, may have contact points with an item to be bent which may be recessed grooves. The frame 105 and/or first path guide 109 may provide structural support and strength to the center die 107. The speed and movement of the center die 107, first sliding die 125, and second sliding die 135 may be adjusted and/or programmed to be controlled by a controller or computer. Additionally, in one embodiment the bending device may comprise secondary bends, such as dogleg bends. Motors may also be used to actuate movement of the center die 107, first sliding die 125, and second sliding die 135 along their respective path guides 120,130. In some embodiments the motors used to actuate movement of the center die 107, first sliding die 125, and second sliding die 135 may be controlled by a computer, software, or manual mechanisms. As shown in FIG. 1, center die 107 may comprise a first bent portion 115, which, during movement of the center die 107, may cause a bend in the tube being bent that is sharper than the curve being created. This sharper bend may happen when the first sliding die 125 bend the tube around the bent portion 115. Although the motors are preferably electric, the movement may be actuated by hydraulics or pneumatics. The motors may preferably configured to work simultaneously to efficiently and quickly bend the tube.

The components of the bending device 100 may comprise various materials, some of which are preferably capable of handling material stress during the bending process. For example, in one embodiment, the bending device 100 may be constructed with hard polymers when bending items that are softer than plastic. In another embodiment, the bending device 100 may be constructed of steel, or another strong metal. Importantly, various components may be connected by various means, including bolts, screws, welds, snap-fitting, pressure, and any other way that materials are known to be held together.

FIG. 2 is an illustration of a top view of one embodiment of the center die, sliding dies, and a tube to be bent and shows the positional relationship of the center die, sliding dies, and tube to be bent at the beginning of the bending process. As shown in FIG. 2, one embodiment of the bending device 200 may comprise: a center die 207, a first path guide 209, a second path guide 220, a first sliding die 225, a third path guide 230, a second sliding die 235, and an item securing portion 240. The center die 207 may comprise an apex portion 210, a first bent portion 215, and a second bent portion 216.

As discussed above, the bending device 200 may be used to bend a tube 245. In one embodiment of the bending device 200, the tube 245 may be placed in between the center die 207, first sliding die 225, and second sliding die 235. Specifically, the center die 207 may be located on one side of the tube 245 while the first sliding die 225 and second sliding die 235 may preferably be located on the opposite sides of the tube 245, such that the tube 245 may be cradled or held in-between the center die 207, first sliding die 225, and second sliding die 235. In this embodiment, the middle portion of the tube 245 may be held against the apex portion 210 of the center die 207, and the end portions of the tube 245 may be held against the first sliding die 225 and second sliding die 235, but on an opposite side of the tube 245. The center die 207 may also comprise an item securing portion 240, which may be used to further secure the tube 245 in a position relative to the central die 207. Once the tube 245 is placed in the desired location, the bending device 200 may begin bending the tube 245.

The process of bending the tube 245 may be accomplished through the three separate moving parts: center die 207, first sliding die 225, and second sliding die 235. As the center die 207 moves along the first predetermined path or first predetermine path guide 209, the tube 245 preferably bends outwards in a substantially convex manner along the curve of center die 207. At the same time, the first sliding die 225 and second sliding die 235, preferably move along the second path guide 220 and third path guide 230 respectively, thereby bending the end portions of the tube 245 inwards. Preferably, the tube 245 is kept in contact with the center die 207, the first bent portion 215 and the second bent portion 216 during the bending process. The item securing portion 240 may be activated after the tube 245 has been placed in its starting position. The item securing portion 240 may latch onto the tube 245 to prevent the secured portion of the tube 245 from moving relative to the center die 207.

Figure 3:
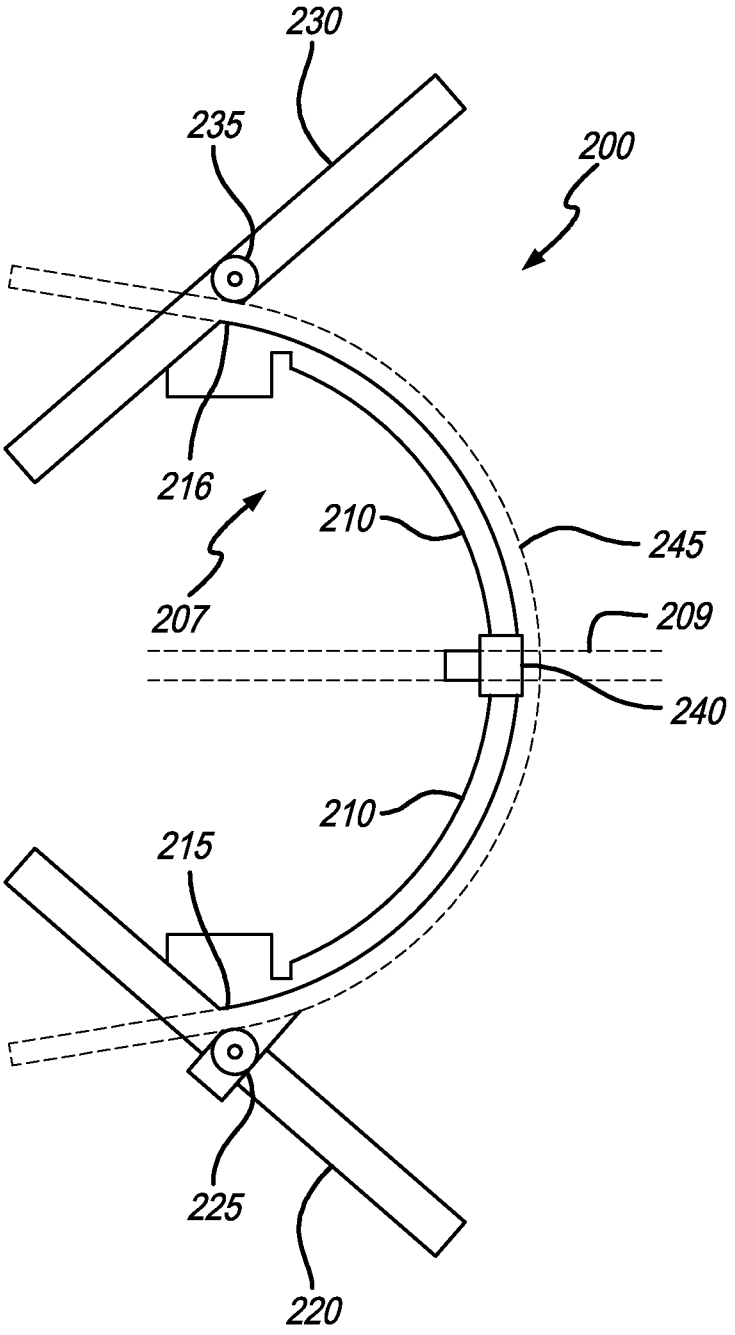
FIG. 3 is an illustration of a top view of one embodiment of the center die, sliding dies, and a tube and shows the positional relationship of the center die, sliding dies and tube during the bending process.

FIG. 3 is an illustration of a top view of one embodiment of the center die, sliding dies, and a tube and shows the positional relationship of the center die, sliding dies and tube during the bending process. As shown in FIG. 3, one embodiment of the bending device 200 may bend a tube 245 in a substantially convex manner. Specifically, the tube 245 may be bent along the apex portion 210 of the center die 207, which may preferably be curved, such that a portion of the tube 245 is in contact with the apex portion 210 to be bent in a convex curved shape. As the tube 245 is bent along the apex portion 210, the pathway of the first sliding die 225 and second sliding die 235 on the second path guide 220 and the third path guide 230, respectively, may preferably come into close proximity with the first bent portion 215 and second bent portion 216 of the center die 207. This preferably allows the first sliding die 225 and second sliding die 235 continue along their respective guide paths 220, 230, and thus, allow the tube 245 to form a secondary bend and tertiary bend along the first bent portion 215 and second bent portion 216, respectively. When the center die 207 has moved and provided sufficient space to allow the second predetermined path 220 and third predetermined path 230 to be substantially in close proximity with the first bent portion 215 and second curbed portion 216 of the center die 207, the center die 207 may temporarily stop moving, which may allow the first sliding die 225 and second sliding die 235 continue movement at the first bent portion 215 and at the second bent portion 216 of the center die 207.

Figure 4:
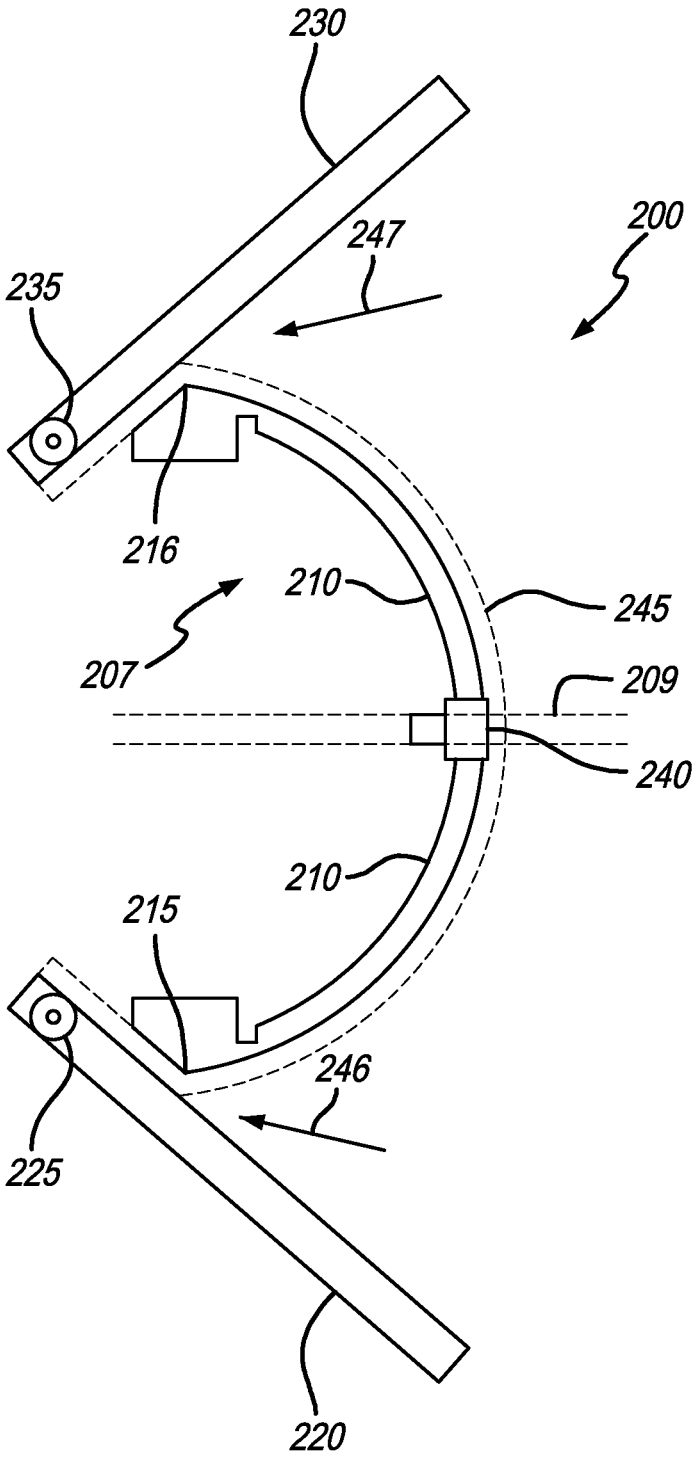
FIG. 4 is an illustration of a top view of one embodiment of the center die, sliding dies, and a tube and shows the positional relationship of the center die, sliding dies and tube at the end of the bending process.

FIG. 4 is an illustration of a top view of one embodiment of the center die, sliding dies, and a tube and shows the positional relationship of the center die, sliding dies and tube at the end of the bending process. As shown in FIG. 4, the first sliding die 225 and second sliding die 235 may continue movement along the second path guide 220 and third path guide 230 around and/or at the first and second bent portions 215, 216. This movement of the first sliding die 225 and second sliding die 235 may be substantially continuous along the second path guide 220 and the third path guide 230. As discussed above, as the first sliding die 225 and second sliding die 235 continue moving, the tube 245 continues to be bent. Importantly, due to the shape of the first bent portion 215 and second bent portion 216, the tube 245 receives a secondary bend 246 and a tertiary bend 247, such that the secondary bend 246 and the tertiary bend 247 are formed by the movement of the first sliding die 225 and second sliding die 235, respectively.

Once the secondary bend 246 and tertiary bend 247 are formed, the bending device 200 may return to an initial configuration as shown in FIG. 2. The tube 245 substantially remains in the bent configuration after the bending device 200 returns to its initial configuration, and the item securing portion 240 may then, if necessary, release the tube 245, which may then be removed from the bending device 200 and a new tube, bar, or device to be bent may be loaded.

Figure 5:
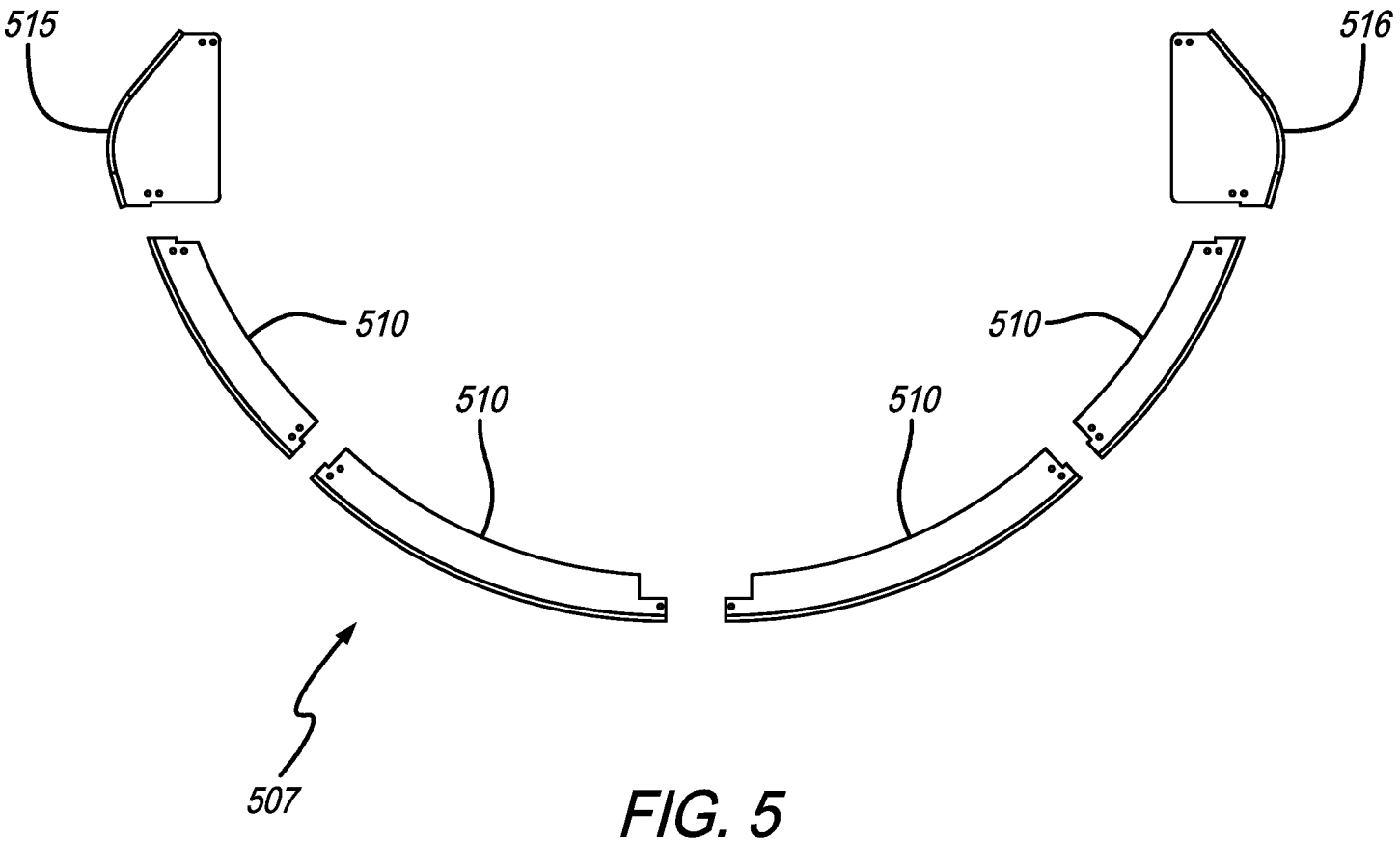
FIG. 5 is an illustration of one embodiment of a center die.

FIG. 5 is an illustration of one embodiment of a center die. As shown in FIG. 5, one embodiment of the center die 507 may comprise an apex portion 510, a first bent portion 515, and a second bent portion 516. The apex portion 510 may be constructed as a single piece or, as shown, may be segmented. Preferably, if the center die is constructed of multiple segmented parts, the segments may preferably each be mounted to a frame, as shown in FIG. 1. The first bent portion 515 and second bent portion 516 may constructed and formed as a continuous piece with the apex portion 510. In an alternative embodiment, the first bent portion 515 and second bent portion 516 may be separate from the apex portion 510. The center die 507 may be attached to a path guide and frame. The center die 507 may have a recessed and/or concave groove, such that a tube engaged with the center die 507 would be substantially cradled by the center die 507 and less prone to slipping or moving.

Figure 6:
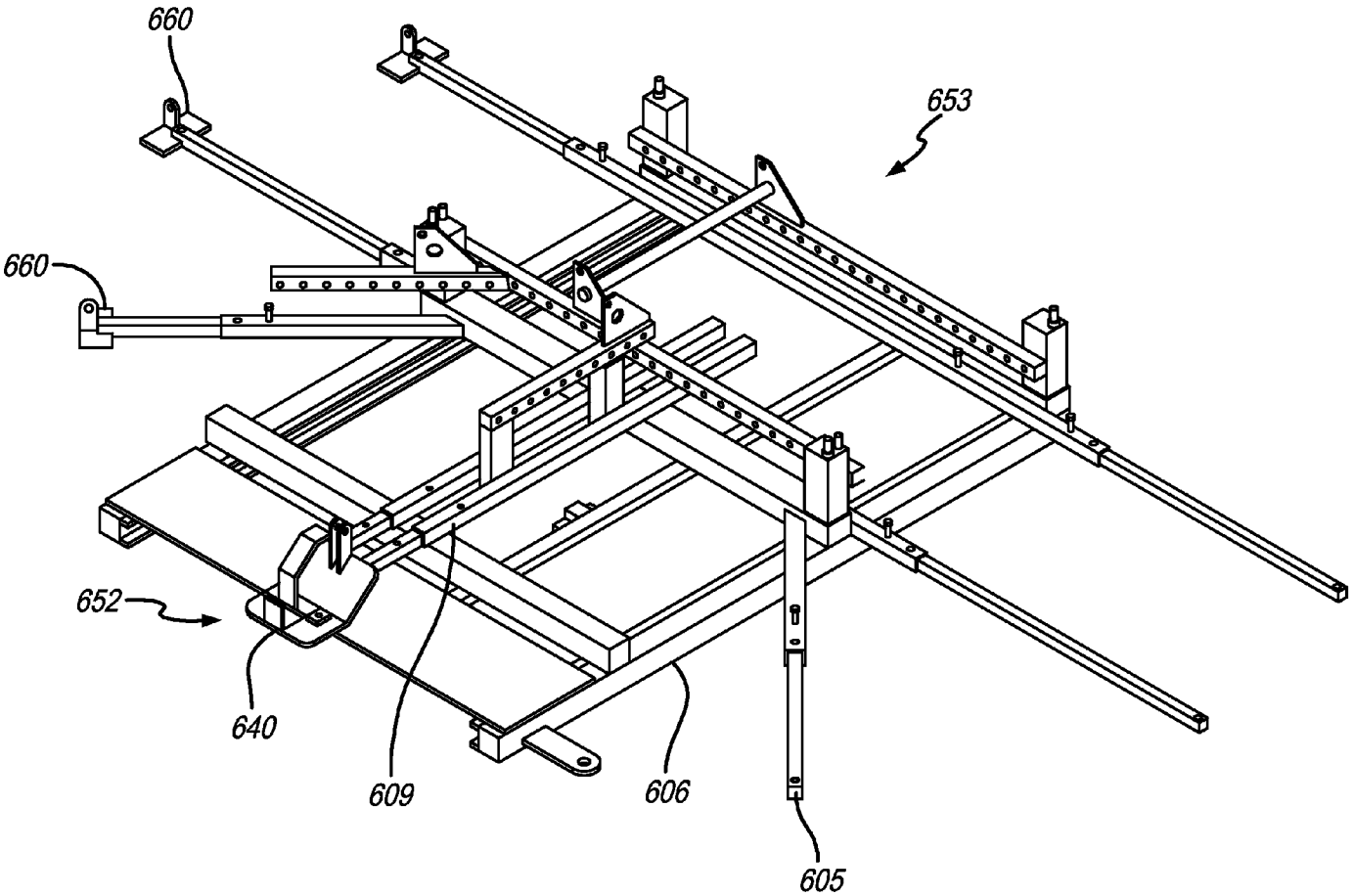
FIG. 6 is an illustration of one embodiment of an internal structure of the frame of the bending device.

FIG. 6 is an illustration of one embodiment of an internal structure of the frame of the bending device. As shown in FIG. 6, the internal structure of the bending device may comprise a bed 606, first path guide 609, frame 605, and item securing portion 640. The frame 605 may be substantially hollow, and the ends may comprise additional frame connecting portions 660 for connecting to a center die. FIG. 6 also shows the proximal end portion 652 of the frame and distal end portion 653 of the frame. Preferably, the center die 107 is configured to move linearly towards a proximal end portion of the frame 605 and retract to the distal end portion 653 of the frame 605 along a first path guide.

Figure 7:
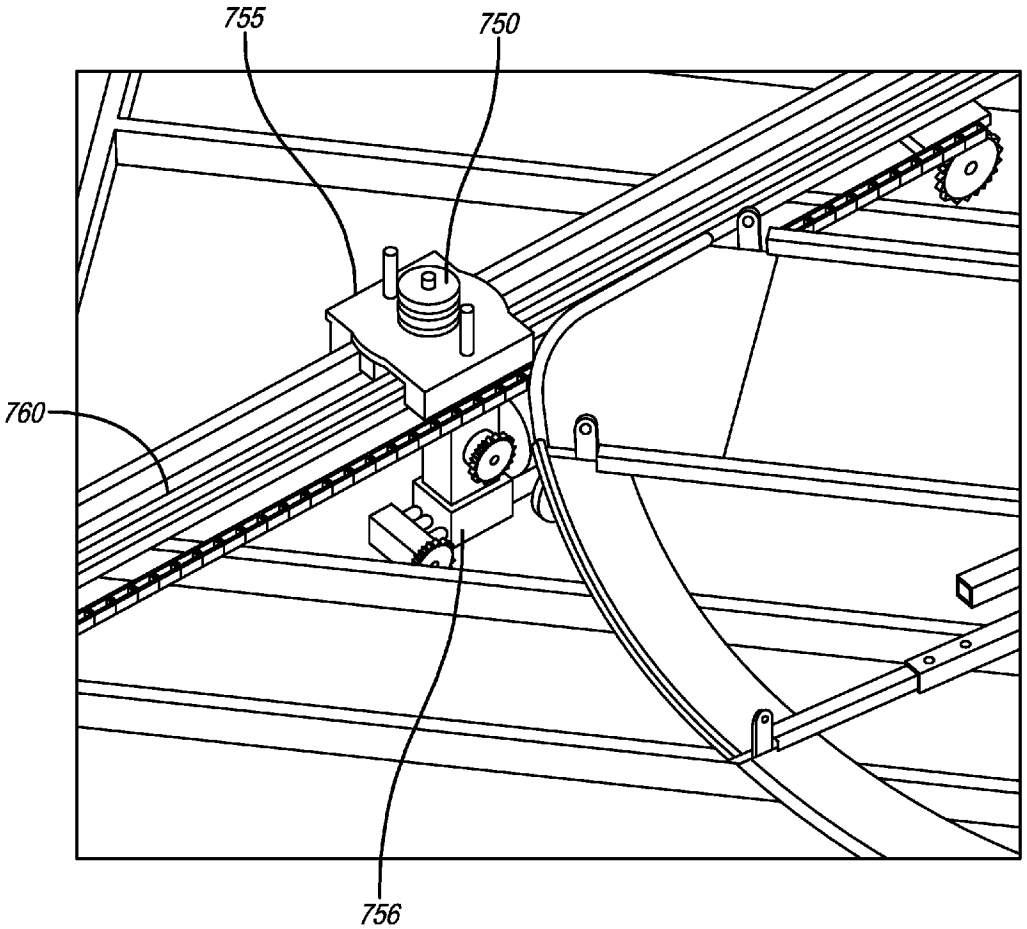
FIG. 7 is an illustration of one embodiment of a sliding die.

FIG. 7 is an illustration of one embodiment of a sliding die. As shown in FIG. 7, one embodiment of the sliding die 750 may be substantially curved and may attach to a sliding die platform 755. The sliding die platform 755 may be mounted on a path guide 760 and the sliding die platform 755 may be configured to travel along the length of the path guide 760. The sliding die platform 755 may be driven by a motor 756. The sliding die platform 755 is preferably configured to move in a forward and rearward along the path guide 760 when the path guide 760 is substantially linear. In another embodiment, it may also be possible that the path guide 760 is non-linear, and therefore, may have a non-linear motion on a respective sliding die platform 755. The sliding die 750 may have a recessed groove along its circumference, such that when a tube is placed against the sliding die 750, the tube and sliding die 750 are substantially, releaseably, and matingly engaged to some degree. The sliding die 750 may be rotably mounted to the sliding die platform 755 to minimize slippage between the sliding die 750 and tube while the sliding die 750 moves. The sliding die 750 may also have a shape substantially similar to an hourglass, though the dimensions may vary.

Figure 8:
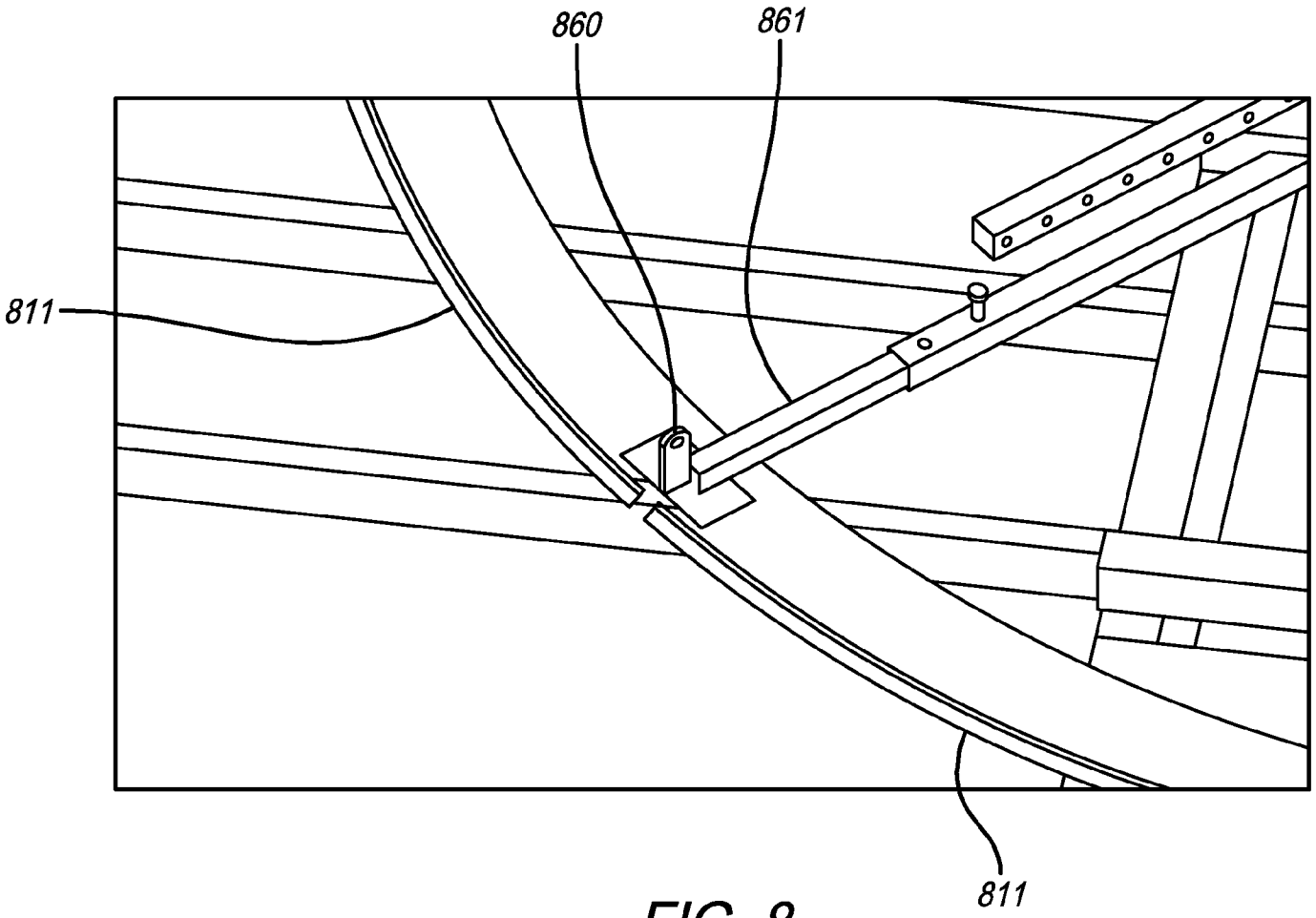
FIG. 8 is an illustration showing one embodiment of the frame connection for the center die.

FIG. 8 is an illustration showing one embodiment of the frame connection for the center die. As shown in FIG. 8, the one embodiment of the center die and frame connection may comprise center die segments 811, a frame end 861 and a frame connecting portion 860. The center die segments 811 may comprise any portion of the center die, including apex portions and bent portions. The frame end 861 may be the end portion of a frame. The frame connecting portion 860 may be used to connect the frame end 861 and the center die segments 811 and may utilize bolts, screws, or any other known connecting or fastening mechanisms.

Figure 9:
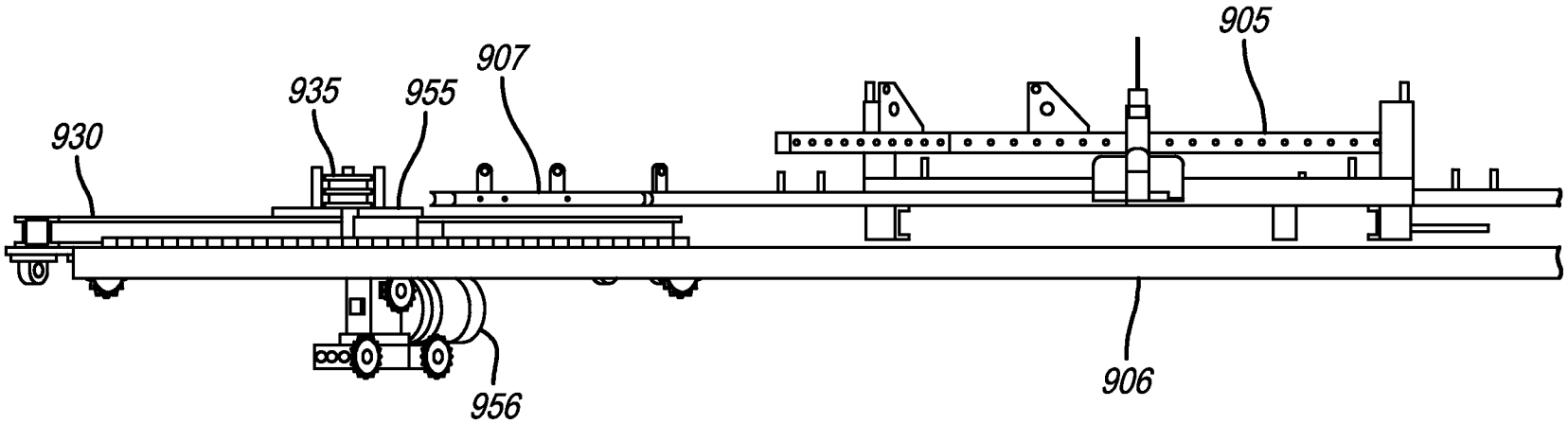
FIG. 9 is an illustration of a side view of one embodiment of the bending device during the bending process.

FIG. 9 is an illustration of a side view of one embodiment of the bending device during the bending process. As shown in FIG. 9, the one embodiment of the bending device may comprise a frame 905, a bed 906, a center die 907, a path guide 930, a sliding die 935, a sliding die platform 955, and a first motor 956.

Figure 10:
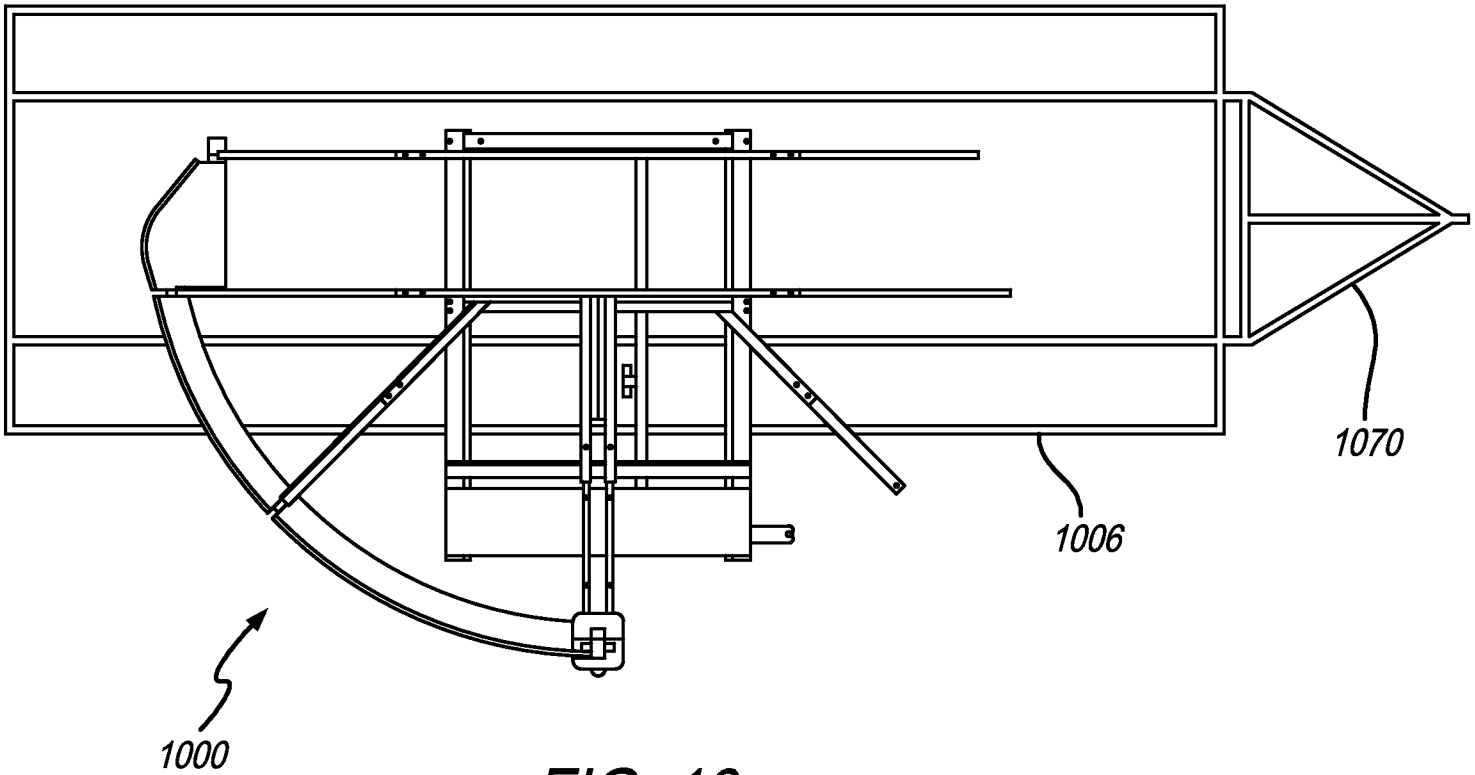
FIG. 10 is an illustration of a top view of one embodiment of the bending device and shows the bending device with a trailer hitch.

FIG. 10 is an illustration of a top view of one embodiment of the bending device and shows the bending device with a trailer hitch. As shown in FIG. 10, one embodiment of the bending device 1000 may comprise a trailer hitch 1070. The trailer hitch 1070 may be an extension of the bed 1006. Alternatively, the trailer hitch 1070 may be a part of, or attached to, any portion of the bending device 1000. The trailer hitch 1070 may be used to more easily move the bending device 1000, and the bending device 1000 may further comprise wheels such that the bending device 1000 may be towed behind a vehicle.

Figure 11:
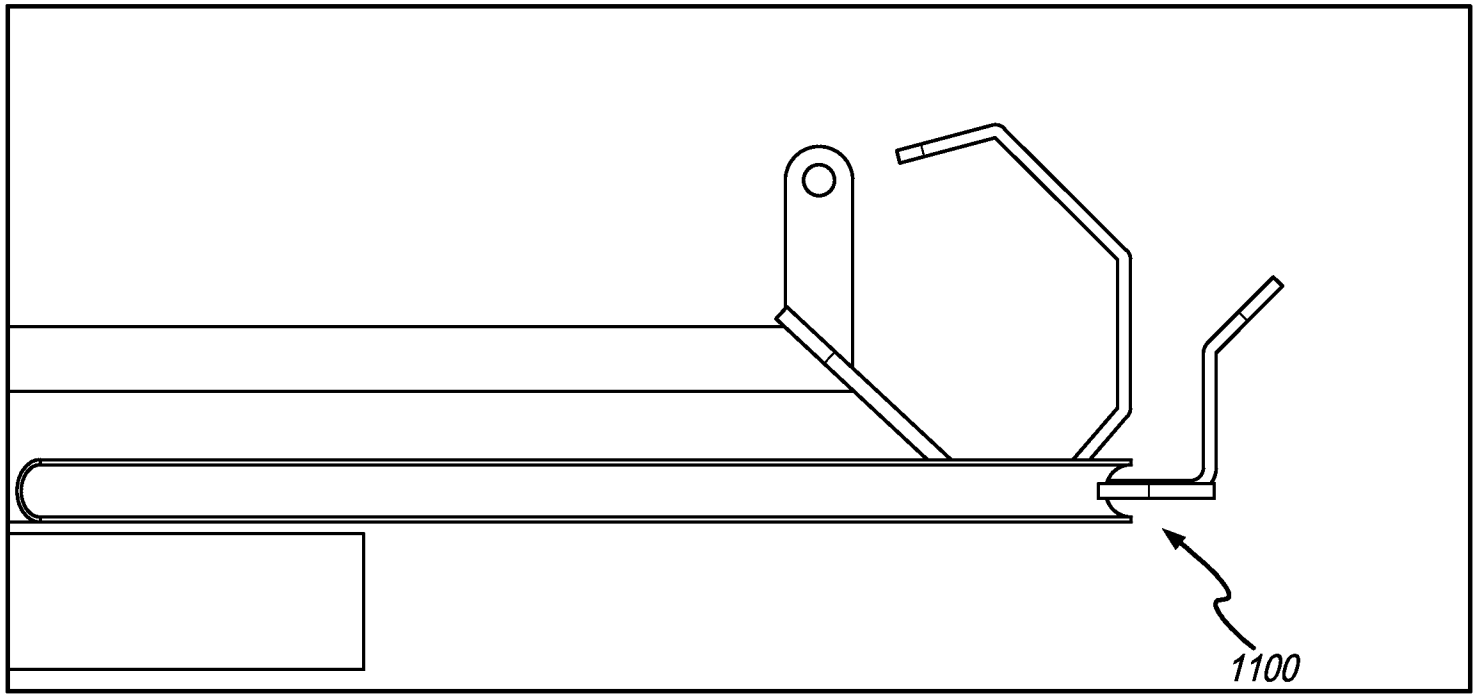
FIG. 11 is an illustration of a side view of one embodiment of the bending device.
Figure 12A:
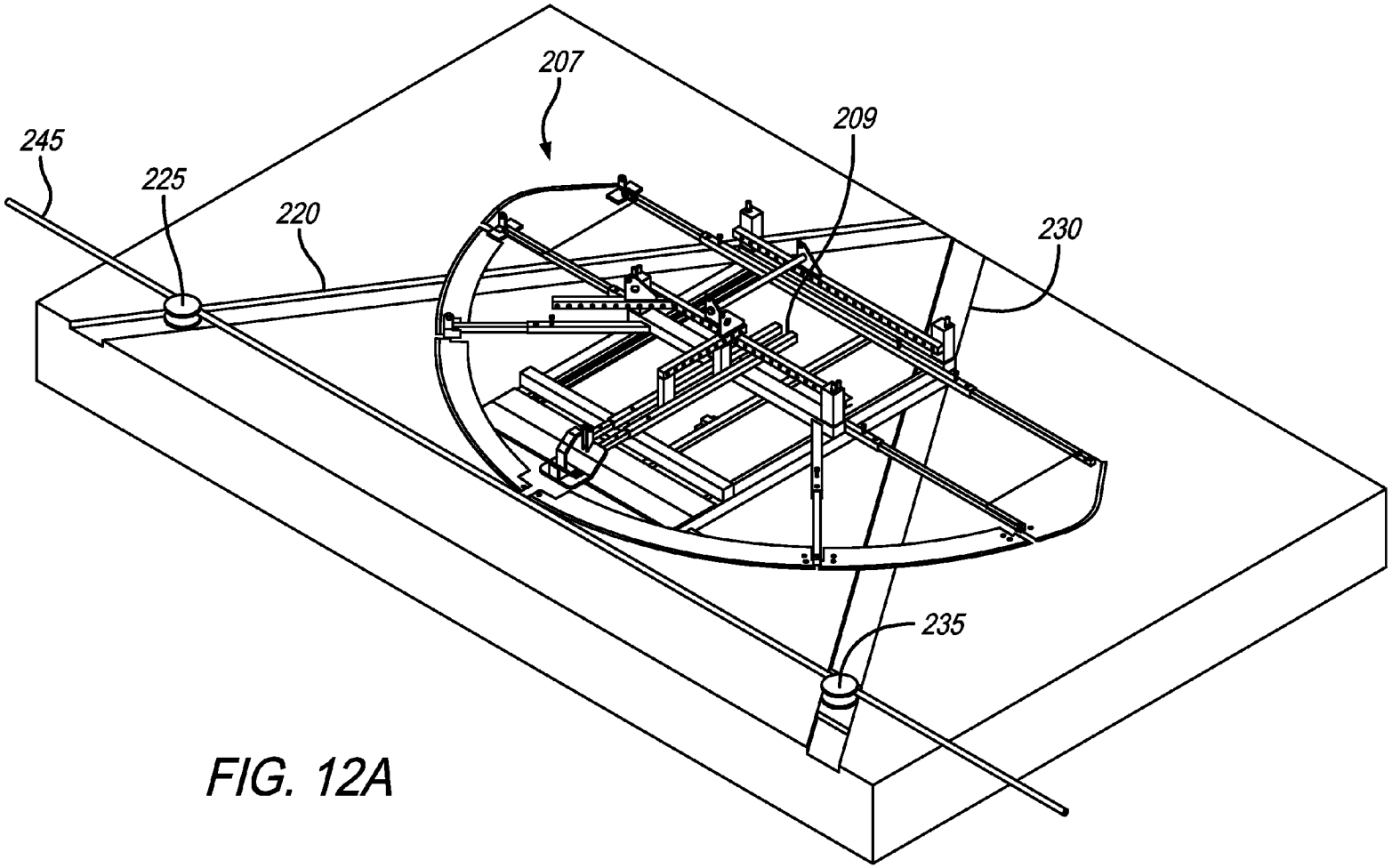
FIGS. 12*a* to 12*d* are illustrations of the bending device and the bending process.
Figure 12B:
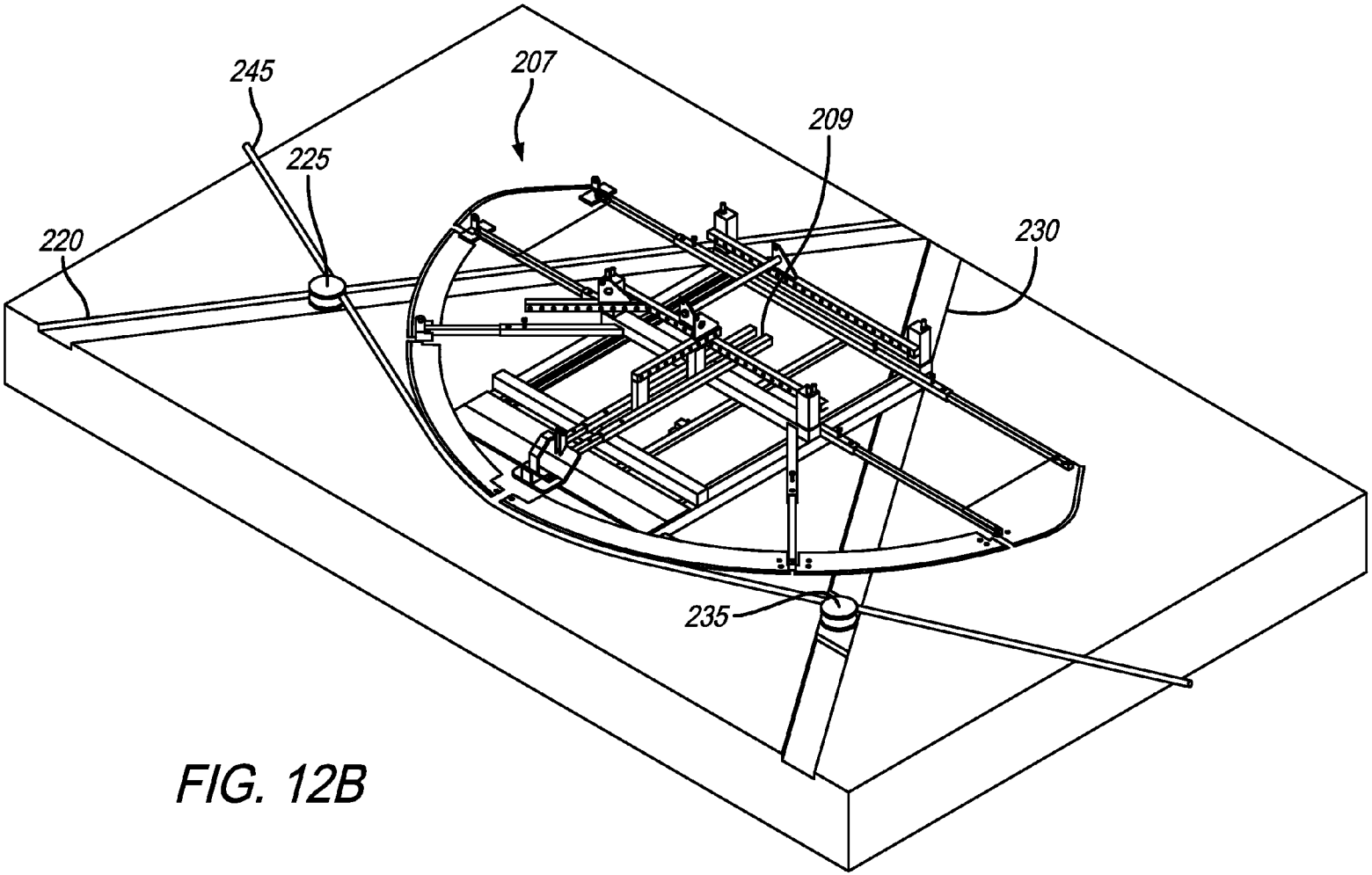
Figure 12C:
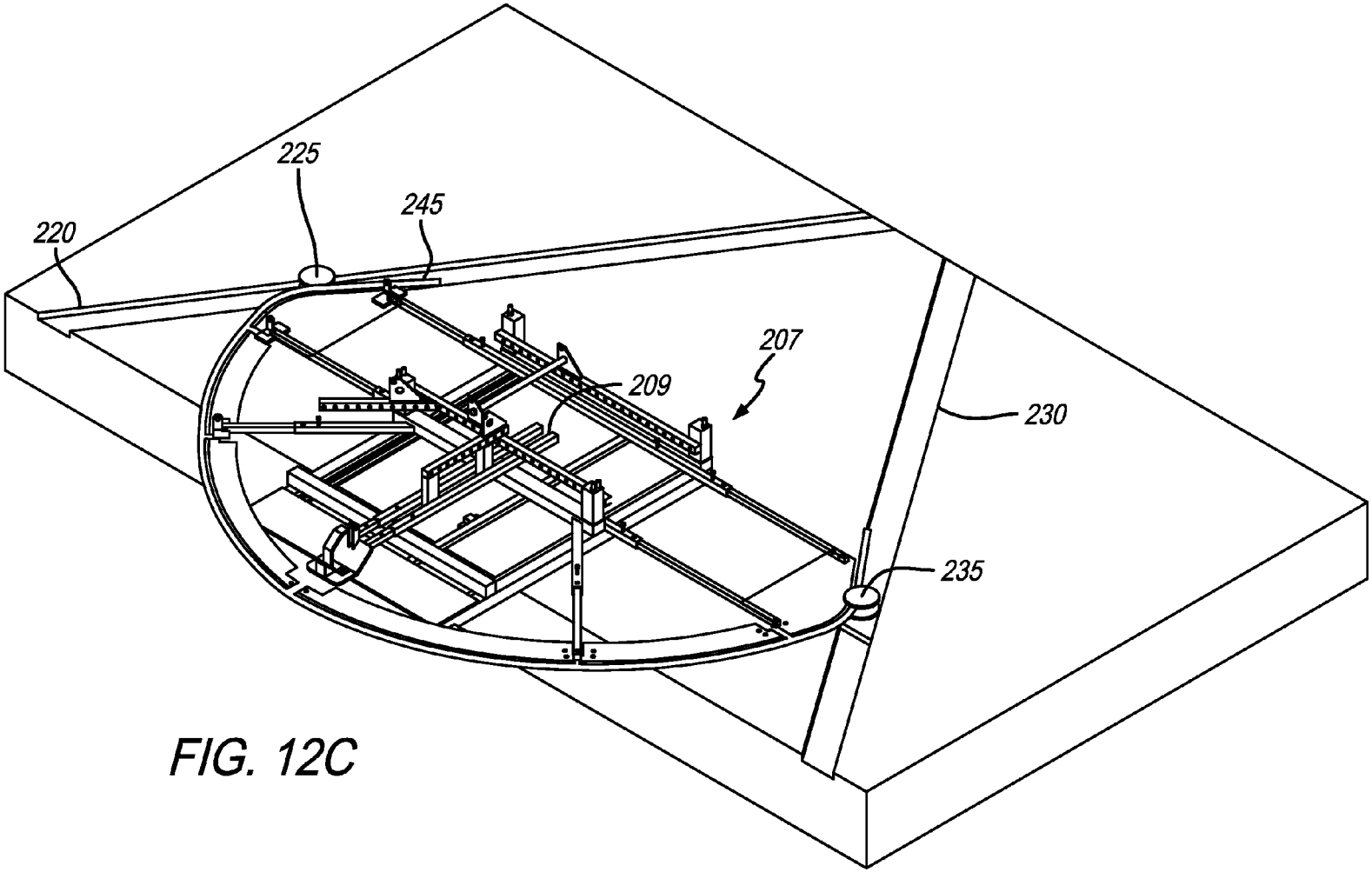
Figure 12D:
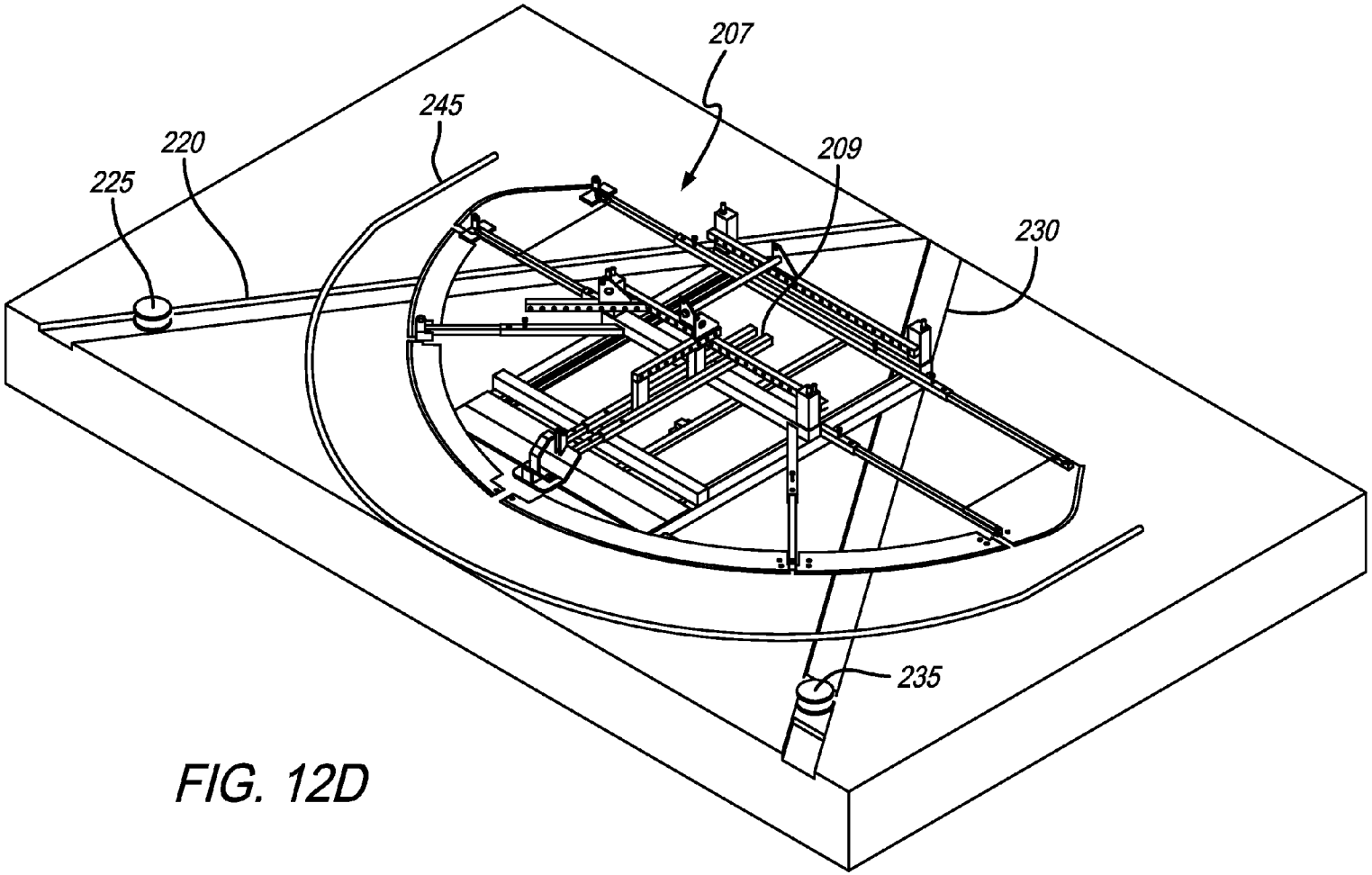

FIG. 11 is an illustration of a side view of one embodiment of the bending device. FIG. 11 also shows that the center die may comprise a recessed/concave groove 1100 for providing curvature support and stability for engaging the tube or pipe to be bent.

FIGS. 12*a* to 12*d* are illustrations of the bending device and the bending process. Specifically, FIGS. 12*a* to 12*d* show how the center die and sliding dies interact with a tube or pipe to create a bent tube/pipe. As shown in FIGS. 12*a* to 12*d*, one embodiment of the bending device 200 may comprise: a center die 207, a first path guide 209, a second path guide 220, a first sliding die 225, a third path guide 230, and a second sliding die 235. FIGS. 12*a* to 12*d* show how the center die 207 may push and engage against the middle portion of the tube 245. FIGS. 12*a* to 12*d* also show how the first sliding die 225 and second sliding die 235 may push the ends of the tube 245 towards the bent portions of the center die 207. This preferably allows the tube 245 to bend outwards in a substantially convex manner along the curve of the center die 207.

Figure 13:
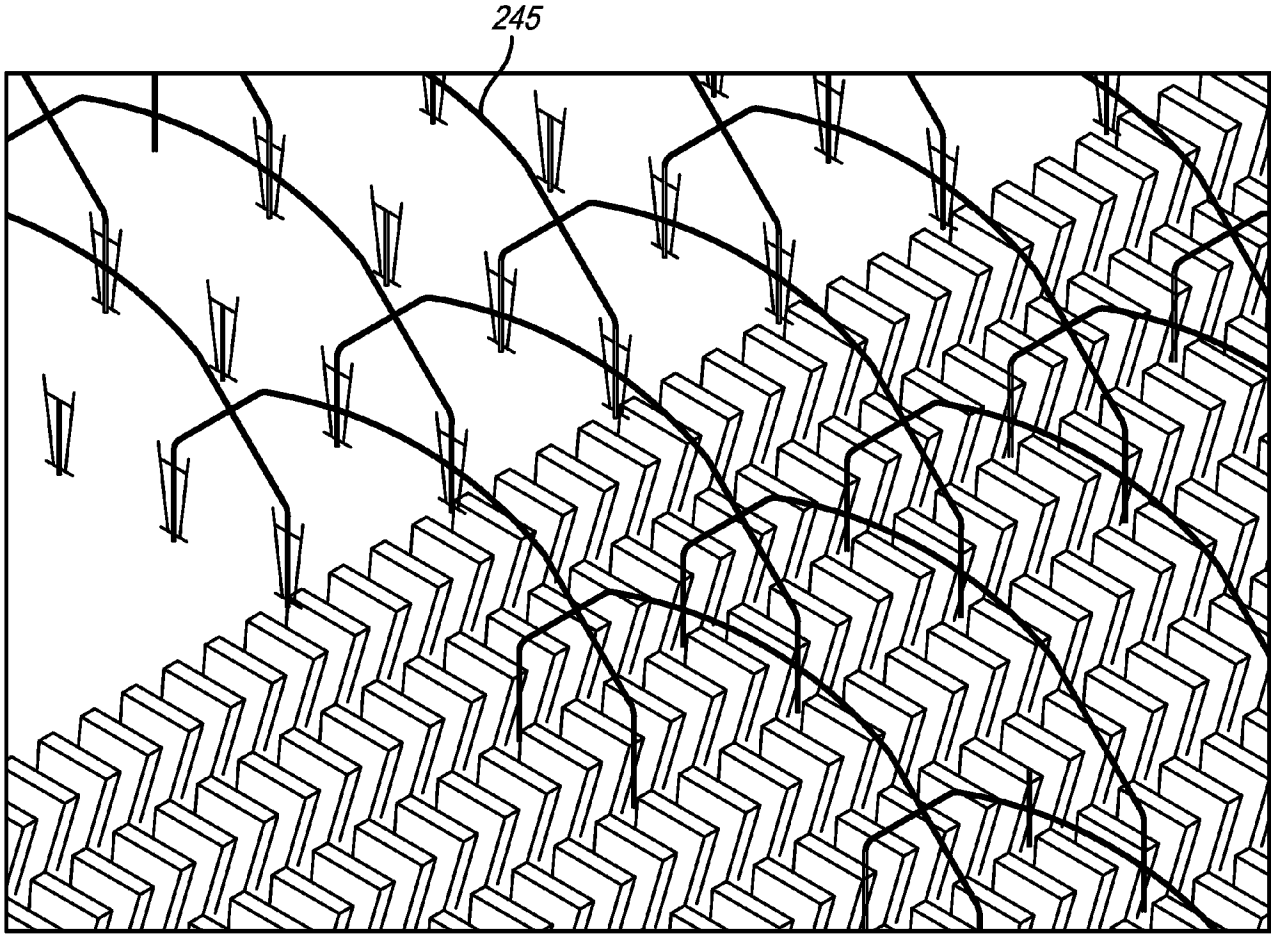
FIG. 13 is an illustration showing one use of tubes bent by one embodiment of the bending device.

FIG. 13 is an illustration showing one use of tubes bent by one embodiment of the bending device. As shown in FIG. 13, the tubes 245 are shown as being set up in a field to create a framework for a greenhouse. The tubes 245 may be longer than usual for a greenhouse structure tube and may have one or more dogleg bends. FIG. 13 also shows how the tubes may be positioned such that they overlap and create an aisle that may accommodate vehicles. In this manner vehicles are able to travel within the greenhouse without bumping into the tubes 245.

Unless otherwise stated, all measurements, values, ratings, positions, magnitudes, sizes, locations, and other specifications that are set forth in this specification, including in the claims that follow, are approximate, not exact. They are intended to have a reasonable range that is consistent with the functions to which they relate and with what is customary in the art to which they pertain.

The foregoing description of the preferred embodiment has been presented for the purposes of illustration and description. While multiple embodiments are disclosed, still other embodiments will become apparent to those skilled in the art from the above detailed description, which shows and describes the illustrative embodiments. These embodiments are capable of modifications in various obvious aspects, all without departing from the spirit and scope of protection. Accordingly, the detailed description is to be regarded as illustrative in nature and not restrictive. Also, although not explicitly recited, one or more embodiments may be practiced in combination or conjunction with one another. Furthermore, the reference or non-reference to a particular embodiment shall not be interpreted to limit the scope of protection. It is intended that the scope not be limited by this detailed description, but by the claims and the equivalents to the claims that are appended hereto.

Except as stated immediately above, nothing that has been stated or illustrated is intended or should be interpreted to cause a dedication of any component, step, feature, object, benefit, advantage, or equivalent, to the public, regardless of whether it is or is not recited in the claims.

What is claimed is:

1. A bending device, comprising:

a frame;

a center die;

a first sliding die;

a second sliding die; and three motors;

wherein said center die is moveable connected to said frame and is configured to move linearly towards a proximal end of said frame along a first path guide;

wherein said center die comprises an apex portion, a first bent portion, and a second bent portion;

wherein said first sliding die is positioned approximately at a left portion of said frame and is configured to advance towards and beyond said first bent portion of said center die along a second path guide;

wherein said second sliding die is positioned approximately at a right portion of said frame and is configured to advance towards and beyond said second bent portion of said center die along a third path guide;

wherein said three motors are configured to actuate said movement of said center die, said first sliding die, and said second sliding die;

wherein said first sliding die, said second sliding die, and said center die are configured to engage and bend a tube;

wherein said center die is configured to engage with and push a middle portion of said tube;

wherein said first sliding die is configured to push a first end of said tube towards said first bent portion of said center die; and wherein said second sliding die is configured to push a second end of said tube towards said second bent portion of said center die.

2. The bending device, according to claim 1, wherein said second and third path guides are positioned such that said first and second sliding dies move diagonally towards said first and second bent portions.

3. The bending device, according to claim 1, wherein said center die, said first sliding die, and said second sliding die are configured to operate simultaneously.

4. The bending device, according to claim 1, wherein said movement of said first sliding die and said second sliding die continues after a first directional movement of said center die has substantially ended.

5. The bending device, according to claim 1, wherein said second path guide is positioned at an angle between approximately 20 and 80 degrees with respect to said first path guide.

6. The bending device, according to claim 1, wherein said third path guide is positioned at an angle between approximately 20 and 80 degrees with respect to said first path guide.

7. The bending device, according to claim 1, wherein said center die has a convex shape around which said tube will be bent.

8. The bending device, according to claim 1, wherein said center die, said first sliding die, and said second sliding die each comprise a recessed groove for receiving said tube to be bent.

9. The bending device according to claim 8, wherein said recessed grooves of said first sliding die and said second sliding die are in substantial alignment with said recessed groove of said center die, such that when said middle portion of said tube is positioned against said recessed groove of said apex portion of said center die and said first end and said second end of said tube are positioned against said first sliding die and said second sliding die, respectively, said tube is cradled and supported by said first sliding die, said second sliding die, and said apex potion of said center die.

10. The bending device according to claim 1, wherein said frame comprises a trailer hitch for towing said bending device.

11. A bending device, comprising:

a frame;

a center die;

a first sliding die;

a second sliding die;

a center die motor; and two sliding die motors;

wherein said center die is moveable connected to said frame and is configured to move linearly towards a proximal end portion of said frame and retract to said distal end portion of said frame along a first path guide;

wherein said center die motor is configured to actuate said movement of said center die;

wherein said center die comprises an apex portion, a first bent portion, and a second bent portion;

wherein said first sliding die is positioned approximately at a left portion of said frame and is configured to advance towards and beyond said first bent portion of said center die along a second path guide;

wherein said second sliding die is positioned approximately at a right portion of said frame and is configured advance towards and beyond said second bent portion of said center die along a third path guide;

wherein said two sliding die motors are configured to actuate said movement of said first said sliding die and said second said sliding die;

wherein said first sliding die and said second sliding die are in substantial alignment with said apex of said center die, such that said first sliding die, said second sliding die, and said center die are configured to engage and bend a tube;

wherein said center die is configured to engage with and push a middle portion of said tube;

wherein said first sliding die is configured to push a first end of said tube towards said first bent portion of said center die when said center die advances along said first path guide; and wherein said second sliding die is configured to push a second end of said tube towards said second bent portion of said center die when said center die advances along said first path guide.

12. The bending device, according to claim 11, wherein said second and third path guides are positioned such that said first and second sliding dies move diagonally towards said first and second bent portions.

13. The bending device, according to claim 12, wherein said center die, said first sliding die, and said second sliding die are configured to operate simultaneously.

14. The bending device, according to claim 13, wherein said movement of said first sliding die and said second sliding die continues after a first directional movement of said center die has substantially ended.

15. The bending device, according to claim 14, wherein said second path guide is positioned at an angle between approximately 30 and 60 degrees with respect to said first path guide; and wherein said third path guide is positioned at an angle between approximately 30 and 60 degrees with respect to said first path guide.

16. The bending device, according to claim 15, wherein said center die has a convex shape around which said tube will be bent.

17. The bending device, according to claim 16, wherein said center die, said first sliding die, and said second sliding die each comprise a recessed groove for receiving said tube to be bent.

18. The bending device according to claim 17, wherein said recessed grooves of said first sliding die and said second sliding die are in substantial alignment with said recessed groove of said center die, such that when said middle portion of said tube is positioned against said recessed groove of said apex portion of said center die and said first end and said second end of said tube are positioned against said first sliding die and said second sliding die, respectively, said tube is cradled and supported by said first sliding die, said second sliding die, and said apex potion of said center die.

19. The bending device according to claim 18, wherein said frame comprises a trailer hitch and one or more wheels for towing said bending device.

20. A bending device, comprising:

a frame;

a center die;

a first sliding die;

a second sliding die;

a center die motor; and two sliding die motors;

wherein said center die is moveable connected to said frame and is configured to move linearly towards a proximal end portion of said frame along a first path guide;

wherein said center die motor is configured to actuate said movement of said center die;

wherein said center die comprises an apex portion, a first bent portion, and a second bent portion;

wherein said first sliding die is positioned approximately at a left portion of said frame and is configured to advance towards and beyond said first bent portion of said center die along a second path guide;

wherein said second sliding die is positioned approximately at a right portion of said frame and is configured advance towards and beyond said second bent portion of said center die along a third path guide;

wherein said two sliding die motors are configured to actuate said movement of said first said sliding die and said second said sliding die;

wherein said first sliding die and said second sliding die are in substantial alignment with said apex of said center die, such that said first sliding die, said second sliding die, and said center die are configured to engage and bend a tube;

wherein said center die is configured to engage with and push a middle portion of said tube;

wherein said first sliding die is configured to push a first end of said tube towards said first bent portion of said center die when said center die advances along said first path guide; and wherein said second sliding die is configured to push a second end of said tube towards said second bent portion of said center die when said center die advances along said first path guide;

wherein said second and third path guides are positioned such that said first and second sliding dies move diagonally towards said first and second bent portions;

wherein said center die, said first sliding die, and said second sliding die are configured to operate simultaneously;

wherein said movement of said first sliding die and said second sliding die continues after a first directional movement of said center die has substantially ended;

wherein said second path guide is positioned at an angle between approximately 30 and 60 degrees with respect to said first path guide;

wherein said third path guide is positioned at an angle between approximately 30 and 60 degrees with respect to said first path guide;

wherein said center die has a convex shape around which said tube will be bent;

wherein said center die, said first sliding die, and said second sliding die each comprise a recessed groove for receiving said tube to be bent;

wherein said recessed grooves of said first sliding die and said second sliding die are in substantial alignment with said recessed groove of said center die, such that when said middle portion of said tube is positioned against said recessed groove of said apex portion of said center die and said first end and said second end of said tube are positioned against said first sliding die and said second sliding die, respectively, said tube is cradled and supported by said first sliding die, said second sliding die, and said apex potion of said center die; and wherein said frame comprises a trailer hitch and one or more wheels for towing said bending device.

* * * * *